United States Patent [19]

Ziegler

[11] 4,195,895

[45] Apr. 1, 1980

[54] CABLE BONDING CLAMP

[75] Inventor: Hans J. Ziegler, Milwaukee, Wis.

[73] Assignee: Reliable Electric Company, Franklin Park, Ill.

[21] Appl. No.: 8,423

[22] Filed: Feb. 1, 1979

[51] Int. Cl.[2] ..... H01R 3/06

[52] U.S. Cl. ..... 339/14 R; 24/135 N; 174/88 R; 269/246; 339/95 R

[58] Field of Search ..... 339/14, 13, 95 R, 113 L, 339/176 R, 191 R, 191 S, 264 R; 24/135 N; 174/78, 88 R; 269/246

[56] References Cited

U.S. PATENT DOCUMENTS

| | | | |
|---|---|---|---|
| 504,017 | 8/1893 | Angier | 269/246 |
| 3,253,247 | 5/1966 | Vos | 339/95 R |
| 3,626,497 | 12/1971 | Lambert et al. | 24/135 N |
| 3,753,213 | 8/1973 | Frey | 174/88 R |

*Primary Examiner*—Roy Lake
*Assistant Examiner*—DeWalden W. Jones
*Attorney, Agent, or Firm*—Quarles & Brady

[57] ABSTRACT

The present invention relates generally to electrical connectors and more particularly to the electrical connectors which are commonly known as cable bonding clamps. Cable bonding clamps are used for providing continuity of the conductive shielding of a communication cable at splice points so as to carry electrical current across the splice and to ground the conductive shield at termination points.

11 Claims, 5 Drawing Figures

CABLE BONDING CLAMP

BACKGROUND OF THE INVENTION

Communication cables are normally comprised of a number of individually insulated conductors bound together within an outer covering which includes an inner insulating sleeve, a foil-like electrically conductive shield surrounding the insulating sleeve and an outer tough protective and insulating jacket. The purpose of the conductive shield is to mechanically protect and to electrically isolate the conductors and to intercept any current from extraneous fields, such as lightning, and to conduct such current to a ground.

When it is necessary to splice or terminate a cable, it is desirable that an electrical connection be made to the conductive shield to either provide continuity of the shield so that electrical current can be carried across the splice or to allow for the conduction of unwanted currents to a ground. Because of its foil-like nature it is difficult to make the desired electrical connection directly to a conductive shield by soldering so that cable bonding clamps are normally employed for that purpose.

A number of patents disclose electrical connectors which can be used as cable bonding clamps. One such patent is U.S. Pat. No. 3,253,247 which shows a clamp body formed from a metal strip which is folded on itself to provide upper and lower jaws joined by a connecting web. A screw extends through a hole in the upper jaw into a threaded opening in the bottom jaw for drawing the two jaws together. In use, the lower jaw is inserted beneath the outer protective insulating jacket of the cable into contact with the conductive shield. The screw is then turned to move the top jaw towards the bottom jaw and thus clamp the jacket of the cable between the two jaws and secure the clamp in place. An electrical conductor is attached to the web to carry any extraneous electric current across a splice or to a ground. A substantial portion of the clamp body, that including the screw and web, extends over the unsheathed portions of the cable and could conceivably cause damage thereto.

Another relatively simple clamp or connector is disclosed in U.S. Pat. No. 3,777,049. The clamp of that patent includes a clamping stud or bolt and a U-shaped clip of conductive material having a multiplicity of small burrs protruding from the inner surfaces of its legs in an area surrounding holes for the clamping stud or bolt. In order to use this clamp, a length of the cable jacket and conductive shield must be both slit lengthwise at one end so that the clamp can be applied and perforated to receive the clamping stud or bolt.

There are numerous other types of prior art cable bonding clamps commercially available. Generally, they are comprised of multiple pieces, some with jaws, that must be carefully aligned and properly assembled prior to use. Most require splitting of the protective jacket of the cable and others when installed have a clamping stud or bolt extending over unprotected portions of the cable where they could conceivably cause damage to the cable.

A need exists for a simple, inexpensive, preassembled, effective cable bonding clamp which does not possess the disadvantages of prior art devices.

SUMMARY OF THE INVENTION

The present invention relates to a cable bonding clamp for making an electrical connection with the inner conductive shield of an insulated cable so that the continuity of the conductive shield can be maintained at splice points and the shield can be grounded at termination points. The clamp includes a generally C-shaped clamp body having a contact arm and a second arm each joined at one end by a bridge. The free end of the contact arm is tapered and shaped to make a good electrical contact or bond with the conductive shield of a cable. A compression arm is hingedly connected to the free end of the second arm. The compression arm is spaced between and extends in the opposite direction to the contact arm and the second arm of the C-shaped body. The clamp further includes means for moving the compression arm towards the contact arm and retaining the compression arm in clamping position so that when the contact arm is inserted beneath the insulating jacket of the cable and into electrical contact with the conductive shield the insulating jacket can be clamped between the compression arm and the contact arm to secure the cable bonding clamp to the cable.

In the preferred embodiment, the compression arm is connected to the second arm of the clamp body by a relatively narrow web of material which serves as an integral hinge, and the means for moving and retaining the compression arm in clamping position is a threaded bolt which cooperates with and extends through a threaded opening in the second arm to first move and then retain the compression arm in a clamping position. The threaded bolt has an integral hexnut positioned intermediate its length which limits the extent the bolt can extend through the opening and the compression arm can be moved toward the contact arm. The clamp body and threaded bolt and nut are of conductive material so that once the clamp is in electrical contact with the conductive shield and secured to the cable, it is of the same electrical potential as the shield. The shield then can be grounded at a terminal by attaching a conductor to the free end of the bolt against the hexnut and to a ground. Continuity of the shield can be provided at a splice by using a pair of the clamps and a conductor to electrically connect the conductive shields of the spliced pieces of cable. The clamp body provides a direct electrical circuit from the shield of the hexnut.

It is the primary object of the present invention to provide an improved, simple, preassembled, effective cable bonding clamp for making a strong electrical and mechanical contact or bond with the conductive shield of a shielded cable.

It is a further object to provide a cable bonding clamp that can be quickly, easily, mechanically and electrically connected to a conductive shield of a shielded, jacketed cable without slitting the protective jacket of the cable.

It is a further object to disclose a cable bonding clamp in which the clamping stud or bolt is not positioned over an unsheathed portion of the cable where it could cause damage to unprotected cable or splice components.

It is another object of this invention to provide a cable bonding clamp which does not depend upon the thread contact of a mounting stud to establish the electrical circuit to the conductive shield of a shielded cable.

It is another object of this invention to provide a cable bonding clamp for a shielded, jacketed cable which can adapt itself to various jacket thicknesses and to various diameters of cable.

It is another object of this invention to provide a cable bonding clamp which will develop an internal spring force when installed upon a shielded, jacketed cable, which force will compensate for cold flow in the jacket to maintain a secure bond with the shield.

These and other objects of the invention will be apparent to those skilled in the art from the description, drawings and claims which follow.

DESCRIPTION OF THE PREFERRED EMBODIMENT

Figure 1:
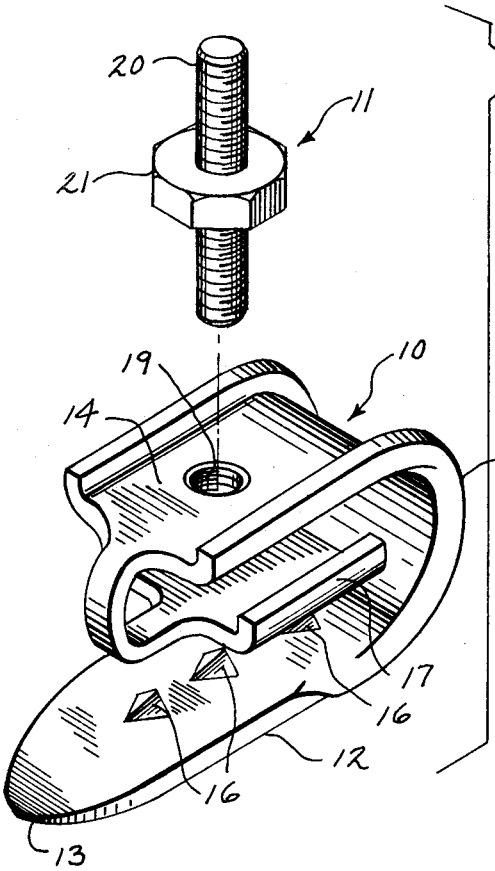
FIG. 1 is an exploded, perspective view showing the components of the preferred embodiment of the cable bonding clamp.

As seen in the drawings, the cable bonding clamp includes a clamp body 10 and a compression member 11. As seen best in FIGS. 1 and 2, the clamp body 10 is generally C-shaped and has an elongated contact arm 12 with a tapered, generally pointed tip 13 and a second arm 14 which is spaced from and generally extends in the same direction as the contact arm 12. The contact arm 12 and the second arm 14 are joined at one end by a curved section or bridge 15. The reinforced bridge 15 maintains the arms 12 and 14 in spaced apart relationship. A plurality of upwardly extending barbs 16 rise from the upper surface of an intermediate portion of the contact arm 12.

Figure 2:
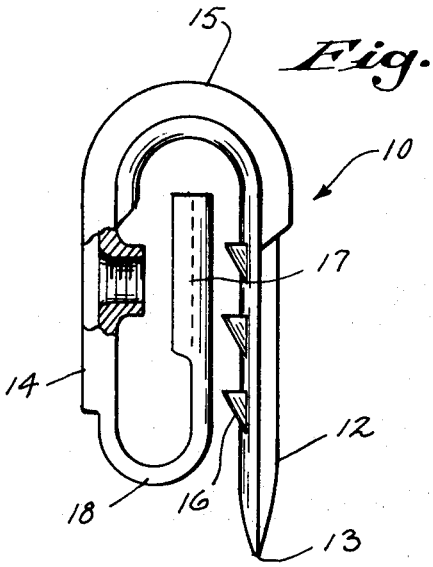
FIG. 2 is a side view partially in section of the clamp body of FIG. 1.
Figure 3:
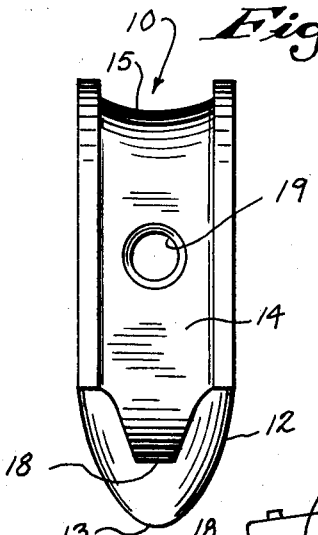
FIG. 3 is a top view of the clamp body of FIG. 2.

Referring still to FIGS. 1 and 2, it can be seen that a compression arm 17 is connected to the other end of the second arm 14 by a curved, relatively narrow web 18 of material. The compression arm 17 is positioned between the contact arm 12 and the second arm 14 of the clamp body 10 and extends in the opposite direction thereto. As seen in FIGS. 1, 2 and 3, the second arm 14 has a threaded opening 19 extending therethrough which is aligned with the compression arm 17.

In the embodiment shown in the drawings, the clamp body 10, web 18 and compression arm 17 are a single, unitary piece preferably formed of spring-type conductive, non-corrosive material such as Phosphor bronze, brass or annealed beryllium copper which has good tensile strength and resiliency. When the clamp body 10 is formed of the spring-type material, the web 18 which is narrow and unreinforced acts as a hinge for the compression arm 17. When less resilient conductive materials are used, it may be necessary to employ a mechanical hinge to connect the compression arm 17 to the end of the second arm 14.

Returning now to FIG. 1, it can be seen that the compression member 11 includes a threaded bolt 20 with an integral hexnut 21. The hexnut 21 is fixed on the bolt 20 at a point intermediate its length and both the bolt 20 and hexnut 21 are made of a conductive, non-corrosive material such as stainless steel or brass.

Figure 4:
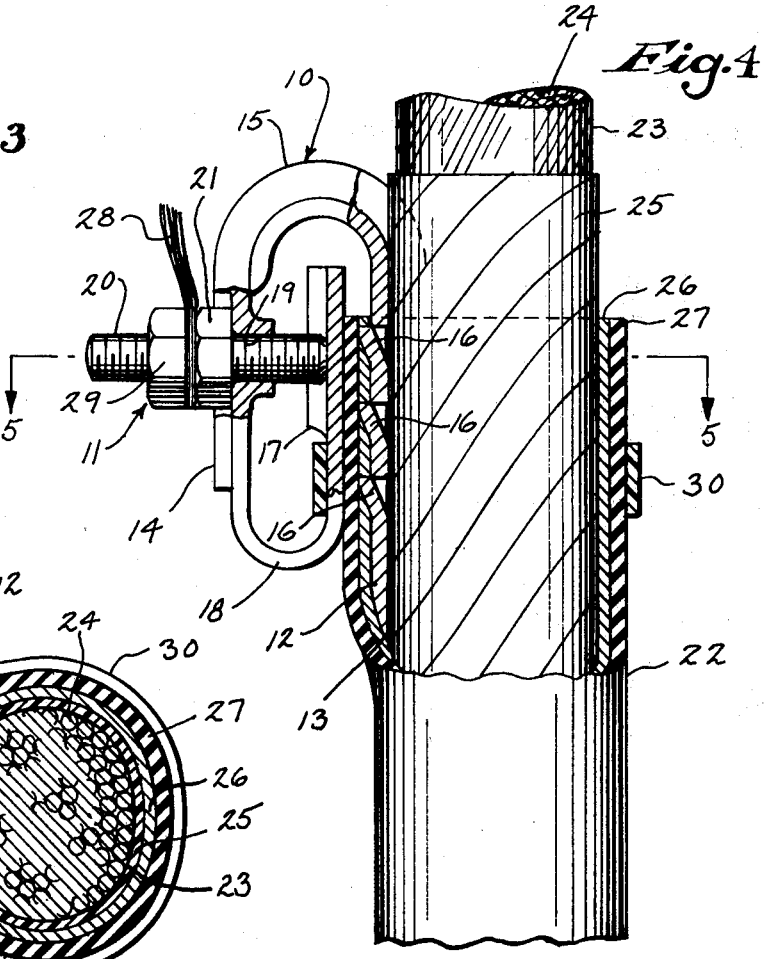
FIG. 4 is a view, partially in section, showing the clamp of FIG. 1 in operative position on a communication cable.
Figure 5:
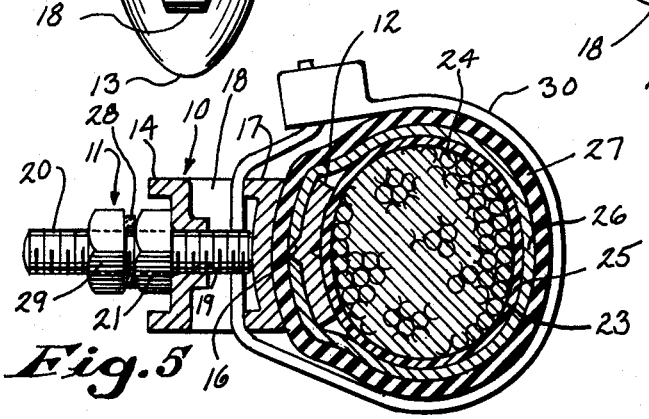
FIG. 5 is a view taken along lines 5—5 of FIG. 4.

FIGS. 4 and 5 illustrate a preferred manner of connecting the cable bonding clamp of the present invention to a cable. As seen therein, a communication cable 22 includes a bundle 23 comprised of a plurality of cable conductors 24, an insulating wrap or sleeve 25 surrounding the bundle 23, then an intermediate conductive shield 26 which is in turn surrounded by an outer protective insulating jacket 27. In the drawings, the thickness of the shield relative to that of the jacket 27 has been exaggerated for purposes of illustration. The contact arm 12 of the clamp body 10 is inserted by forcing the tapered, generally pointed tip 13 of the contact arm 12 between the insulating wrap or sleeve 25 and the conductive shield 26 of the cable. This is accomplished without slitting the cable as is necessary with some prior art devices. Once the contact arm 12 is fully inserted and the clamp body 10 is in place on the cable 22 the compression member 11 which is threadedly engaged in the opening 19 is moved by means of the integral hexnut 21 and in turn moves the hinged compression arm 17 towards the contact arm 12. The conductive shield 26 and the outer insulating jacket 27 which are sandwiched between the contact arm 12 and the compression arm 17 are gripped vise-like and the barbs 16 on the upper surface of the contact arm 12 will pierce the shield 26 and prevent removal of the clamp. The act of insertion will wipe oxides or protective coatings from the surface of the shield 26 so that a good electrical contact can be established between the upper surface of the contact arm 12 and the shield 26. The entire clamp assembly which is conductive is now electrically of the same potential as the conductive shield 26 and thus a good bond has been made.

The compression member 11 is then further tightened by use of the hexnut 21 until the face of the hexnut 21 hits the outer surface of the second arm 14 which signals to the user that a proper anchoring of the clamp on the cable has been made. A conductor 28 is then attached to the free end of the threaded bolt 20 by use of another nut 29. The conductor may lead to a ground for the conductive shield 26 or may be connected to another clamp on the other side of a splice to provide electrical continuity for the conductive shield 26.

With the compression member 11 tightened to the point where the hexnut 21 contacts the outer surface of the second arm 14, a conductive path from the shield 26 is established through the contact arm 12, the bridge 15 and the second arm 14 directly to the hexnut 21. This conductive path does not depend upon the thread contact between the stud 21 and the clamp body 10 and therefore does not depend upon the degree of contact of the threads with the nut 21 or with the internally threaded opening 19.

The bridge 15 is relatively rigid compared with the web 18. As a result, upon installation the web 18 can be deformed by the compression member 11 until the hexnut 21 seats against the second arm 14. The bridge 15 does, however, possess limited flexibility and as a result can act as a spring. The limited flexibility afforded by the bridge 15 permits the accommodation of various thicknesses of protective jackets 27 and various diameters of cable 22. During installation, the arms 12 and 14 will typically be urged apart somewhat and the spring force which will be developed in the bridge 15 will assist in maintaining the bolt 20 in contact with the compression arm 17 by taking up any backlash inherent in the mating threads of the bolt 20 and threaded opening 19. The spring force built up in the bridge 15 will also insure that the clamp maintains a good grip upon the shield and jacket even though the jacket material deforms away from the clamp due to cold flow.

When the cable bonding clamp is employed as one of a pair on either side of a splice, the connection between the two cable bond clamps may function on both a mechanical and an electrical connection. In such situations the cables may tend to move toward or away from each other and there may be a tendency for the connection attached at the top of the hexnut to cause the cable bond clamp to unroll at the bridge 15. Such a force can be prevented from dislodging or reducing the grip of the cable bond clamp on the shielded jacket by the installation of a simple, common wire wrap 30 which encircles the cable and fits over the compression arm 17 at the point where it is connected to the web 18, as shown in FIGS. 4 and 5.

It will be apparent to those skilled in the art that the cable bonding clamp of the present invention which eliminates the need for slitting the jacket and/or shield of the cable greatly reduces installation time for the clamp. Furthermore, it will be apparent that the installation of the preferred clamp eliminates any possibility of there being damage to the cable such as could occur with the use of sharp cutting tools. In addition, the compression member of the clamp of the present invention is positioned over a jacketed, protected portion of the cable; therefore, it is less likely than prior art clamps to cause damage to the cable even under extraordinary conditions of use. Also, the conductive path from the shield of the cable is established directly through the clamp body and the clamp body includes an integral bridge portion which exerts a spring force to aid in maintaining the clamp in place upon a cable.

Still further advantages of the clamp will be apparent to those skilled in the art who will appreciate that variations and modifications can be made without departing from the spirit and scope of the present invention. Therefore, it is intended that the invention only be limited by the claims which follow.

I claim:

1. A cable bonding clamp for making an electrical connection with the inner conductive shield of an insulated communication cable includes:

(a) a generally C-shaped clamp body having:
  (1) a first contact arm for insertion beneath the insulation of the cable and into contact with the conducting shield, and
  (2) a second arm attached to the first by a bridge, said second arm extending substantially parallel to and in the same direction as the first arm, (b) a compression arm hingedly connected to the end of the second arm, said compression arm extending in the opposite direction of the first and second arms and being positioned between said arms, and (c) means for moving the compression arm toward the contact arm so that when the contact arm is in contact with the conductive shield of the cable the portion of the cable external to the conductive shield can be clamped between the compression arm and the contact arm to secure the cable bonding clamp to the cable.

2. The cable bonding clamp of claim 1 in which the means for moving the compression arm includes means for the electrical connection of a conductor to the clamp.

3. The cable bonding clamp of claim 1 in which the means for moving the compression arm toward the first arm includes a threaded opening extending through the second arm, said opening being aligned with the compression arm, and an elongated, threaded member which cooperates with the threaded opening to move the compression arm towards the contact arm and retain it in a clamping position.

4. The cable bonding clamp of claim 1 in which the compression arm is hinged to the second arm by an integral web.

5. The cable bonding clamp of claim 1 in which the bridge joining the first and second arms is an integral reinforced, curved section which permits the compression arm to be moved toward the contact arm without deforming the clamp body and which functions to provide a spring force to urge the first and second arms toward each other.

6. The cable bonding clamp of claim 3 in which the elongated, threaded member has a fixed nut intermediate its length which limits the extent the threaded member can move the compression arm.

7. The cable bonding clamp of claim 3 in which the threaded member includes means for electrically connecting a conductor to the clamp.

8. The cable bonding clamp of claim 1 in which the clamp body is of a conductive material.

9. The cable bonding clamp of claim 1 in which the contact arm has a tapered generally pointed tip.

10. The cable bonding clamp of claim 1 in which the contact arm has barbs which will pierce the conductive shield and prevent removal of the clamp from the cable.

11. A cable bonding clamp for making an electrical connection with the inner conductive shield of a jacketed communication cable comprising:

a clamp body having a first contact arm for insertion beneath the insulation of the cable and into contact with the conducting shield, a second arm spaced from and overlying the first, an integral bridge of limited flexibility joining one end of the second arm to an end of the first contact arm, and a compression arm extending between the first and second arms and integrally connected to the opposite end of the second arm by a web of reduced cross section; and a compression mechanism for moving the compression arm toward the contact arm and including a stud threadedly received in a threaded opening formed in the second arm, and a nut fixed to the stud and adapted to come to a stop against the outer surface of the second arm.

* * * * *